US011090934B2

(12) United States Patent
O'Reilly et al.

(10) Patent No.: US 11,090,934 B2
(45) Date of Patent: Aug. 17, 2021

(54) PRINT FLUID MANIFOLD

(71) Applicant: Hewlett-Packard Development Company, L.P., Spring, TX (US)

(72) Inventors: Aidan O'Reilly, Leixlip (IE); Tommy O'Connor, Leixlip (IE); Enda Malone, Leixlip (IE); David Kelly, Leixlip (IE)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/636,578

(22) PCT Filed: Aug. 31, 2017

(86) PCT No.: PCT/US2017/049656

§ 371 (c)(1),
(2) Date: Feb. 4, 2020

(87) PCT Pub. No.: WO2019/045731

PCT Pub. Date: Mar. 7, 2019

(65) Prior Publication Data

US 2021/0154999 A1 May 27, 2021

(51) Int. Cl.
*B41J 2/14* (2006.01)

(52) U.S. Cl.
CPC .. *B41J 2/14145* (2013.01); *B41J 2002/14419* (2013.01)

(58) Field of Classification Search
CPC ..... B41J 2/14145; B41J 2002/14419; B41J 2/17513; B41J 2/17503; B41J 2/1637; B41J 2/1603; B41J 2/1623; B41J 2/1703; B41J 2/14032
USPC ..... 347/20, 40, 43, 54, 68, 86
See application file for complete search history.

(56) References Cited

U.S. PATENT DOCUMENTS

| | | | | |
|---|---|---|---|---|
| 6,033,064 | A | 3/2000 | Pawlowski, Jr. | |
| 7,195,345 | B2 | 3/2007 | Shinada et al. | |
| 7,237,884 | B2 | 7/2007 | Sacco et al. | |
| 7,934,822 | B2 | 5/2011 | Miyazawa et al. | |
| 8,025,374 | B2 * | 9/2011 | Berry | B41J 29/02 347/85 |
| 2002/0101487 | A1 | 8/2002 | Petersen | |
| 2002/0113837 | A1 | 8/2002 | Dewey | |
| 2009/0153602 | A1 | 6/2009 | Brown et al. | |

(Continued)

FOREIGN PATENT DOCUMENTS

| | | | |
|---|---|---|---|
| EP | 0778142 | B1 | 6/1997 |
| WO | WO-2007037528 | A1 | 4/2007 |
| WO | WO-2017036490 | A1 | 3/2017 |

OTHER PUBLICATIONS

OctoInkjet ~ SquEasyFill ~ May 24, 2017 ~ 4 pages < http://www.octoink.co.uk/pages/SquEasyFill.html >.

*Primary Examiner* — An H Do
(74) *Attorney, Agent, or Firm* — HP Inc. Patent Department

(57) ABSTRACT

A manifold to provide print fluid to a printhead, the manifold comprising: an inlet to receive print fluid from a print fluid supply; and an outlet to provide print fluid to the printhead; the inlet to couple with a flow control device to control flow of print fluid from the print fluid supply to the manifold; and wherein the inlet comprises an element to engage an actuatable member of the flow control device to activate the flow control device to allow print fluid to flow from the print fluid supply to the printhead.

20 Claims, 6 Drawing Sheets

(56) References Cited

U.S. PATENT DOCUMENTS

| | | | |
|---|---|---|---|
| 2009/0219323 | A1 | 9/2009 | Silverbrook |
| 2010/0157001 | A1 | 6/2010 | Berry |
| 2010/0253742 | A1 | 10/2010 | Essen |

* cited by examiner

PRINT FLUID MANIFOLD

BACKGROUND

Some inkjet printers use a continuous ink supply system (CISS) to supply relatively large volumes of print fluid or ink to a relatively small inkjet printhead. Such a system generally comprises an ink reservoir or print fluid supply which is statically located away from the carriage-mounted printhead. The print fluid supply is typically much larger than the carriage-mounted ink reservoirs found in consumer inkjet printers and therefore the supply is not mounted on the carriage because it may inhibit the movement of the carriage due to its weight and inertia.

Instead only a printhead assembly is mounted on the carriage. The printhead assembly comprises a manifold connected to a printhead. Print fluid is supplied to the printhead by one or more flexible tubes connected between the print fluid supply and the manifold. The flexible tubes are typically sufficiently long to accommodate the movement of the carriage and may be releasably connectable to the manifold to allow for the printhead assembly to be changed. The flexible tubes may have valves or another flow control device to control the flow of print fluid to the manifold.

BRIEF DESCRIPTION OF THE DRAWINGS

The following description is provided by way of example and with reference to the accompanying drawings, in which.

DESCRIPTION

Figure 1:
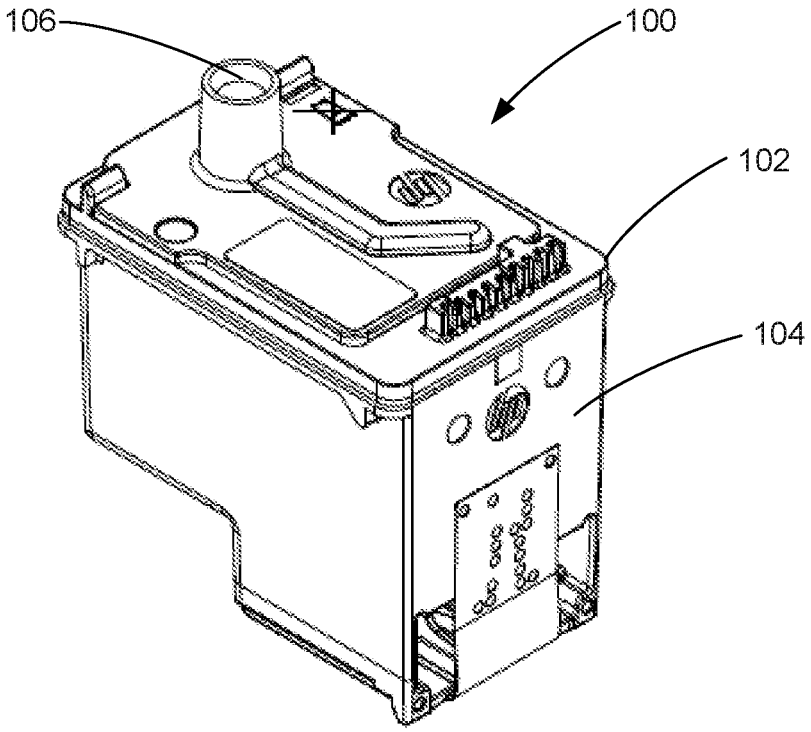
FIG. 1 is a perspective view of an example of a printhead assembly having a single inlet.

In overview this disclosure concerns a manifold for a printhead assembly, in which the manifold comprises an inlet having an element or valve rib which automatically opens or activates a flow control device or valve when the flow control device is engaged with the inlet.

Previous approaches to manifold design have not used an inlet having an element or valve rib which automatically opens or activates a flow control device or valve when the flow control device is engaged with the inlet.

Considered in general outline, the present disclosure relates to a manifold to provide print fluid to a printhead, the manifold comprising: an inlet to receive print fluid from a print fluid supply; and an outlet to provide print fluid to the printhead; the inlet to couple with a flow control device to control flow of print fluid from the print fluid supply to the manifold; and wherein the inlet comprises an element to engage an actuatable member of the flow control device to activate the flow control device to allow print fluid to flow from the print fluid supply to the printhead.

The element may be arranged to provide an engagement surface and a print fluid passageway within the inlet, the engagement surface to engage the actuatable member of the flow control device. The element may extend across the inlet. The print fluid passageway may pass at a side of the element.

In an example of the disclosure the print fluid passageway may comprise a first print fluid passageway and the side comprises a first side of the element. The manifold may further comprise a second print fluid passageway which passes at a second side of the element, wherein the second print fluid passageway may comprise a conduit which passes between the first and second sides of the element.

The first and second print fluid passageways may be in fluid communication with the outlet. The width of the first and second print fluid passageways may be less than the width of the actuatable member. The engagement surface may be flat.

The inlet may comprise a sleeve to receive the flow control device, the sleeve extending from an external surface of the manifold. The element may be located at a base of an interior of the sleeve and extend from the base of the sleeve to engage the actuatable member to activate the flow control device. The conduit is located at the base of the sleeve. The manifold may further comprise a print fluid channel to provide fluid communication between the inlet and the outlet. The element may comprise a valve rib.

In another example of the disclosure, the manifold may comprise a plurality of inlets, outlets and print fluid channels.

An example of the disclosure is a printhead assembly comprising the manifold as disclosed and a printhead.

Examples of the disclosure will now be described by way of illustrative example. In the described examples like parts may be indicated in the drawings using like reference numerals.

Referring to FIG. 1, an example printhead assembly 100 of the disclosure comprises an example manifold 102 and a printhead 104. The manifold 102 has a single inlet for receiving print fluid of a certain colour from a print fluid supply (not shown). The colour of the print fluid may be, for example, black. The manifold 102 is laser welded to the printhead 104, although the skilled person will appreciate that other suitable methods of attachment may be used.

Figure 2:
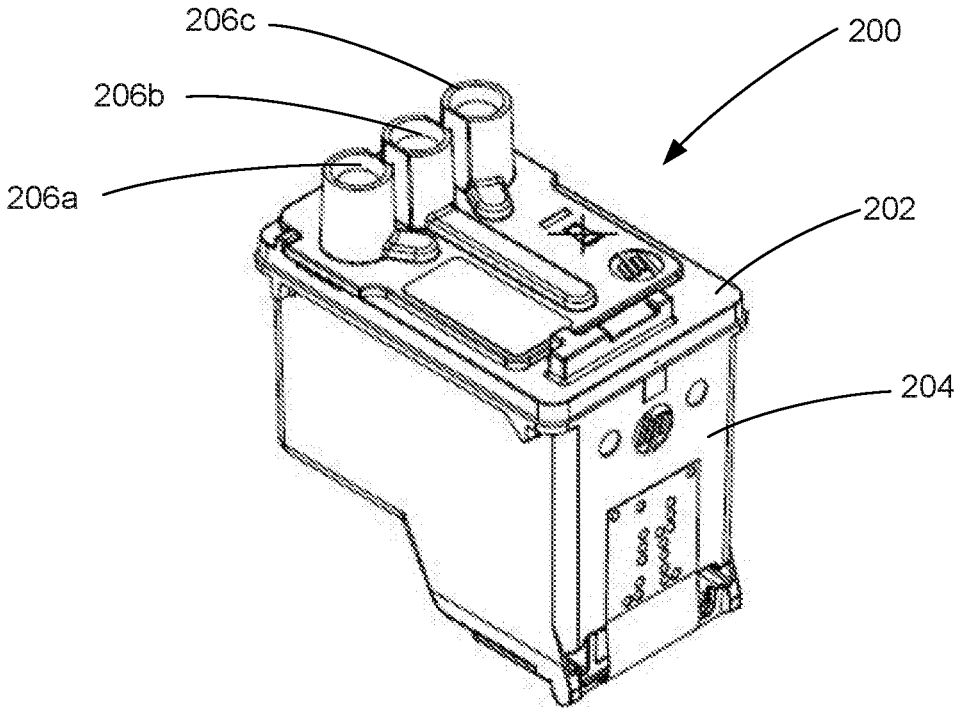
FIG. 2 is a perspective view of another example of a printhead assembly having three inlets.

Another example printhead assembly 200 is shown in FIG. 2 and comprises an example manifold 202 and a printhead 204. The manifold 202 has three inlets 206*a*, 206*b* and 206*c*, for receiving print fluid of different colours from a print fluid supply (not shown). The different colours of the print fluid may be, for example, cyan, yellow and magenta. The manifold 202 is laser welded to the printhead 204, although the skilled person will appreciate that other suitable methods of attachment may be used.

Figure 3:
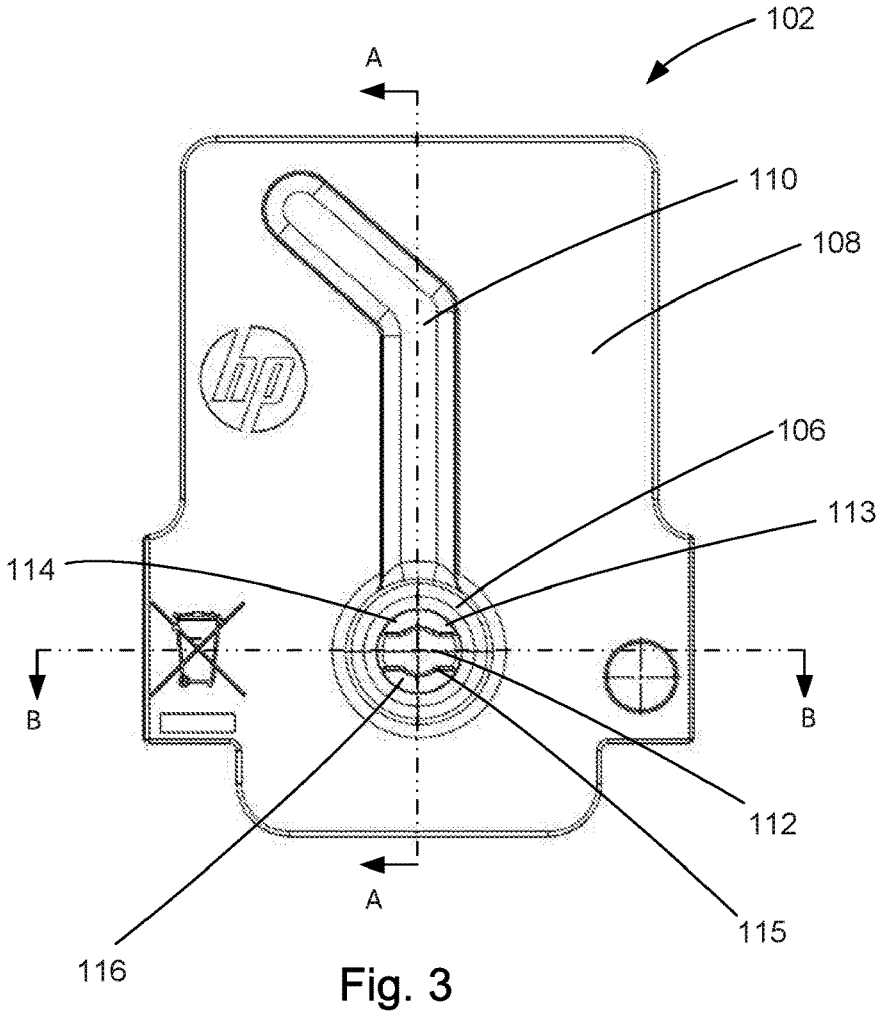
FIG. 3 is a plan view of an example of a manifold having a single inlet.

FIG. 3 shows a plan view of the example manifold 102. The inlet 106 is formed at an upper or external surface 108 of the manifold 102 and is connected to an outlet (not shown) by a print fluid channel 110. An element or valve rib 112 extends across the inlet 106. In the described example the element 112 extends along a diameter of the inlet 106. However, the skilled person will appreciate that the element could extend in different configurations. The element 112 divides the inlet 106 into first 114 and second 116 print fluid passageways which pass at respective first 113 and second 115 sides of the element 112.

Figure 4:
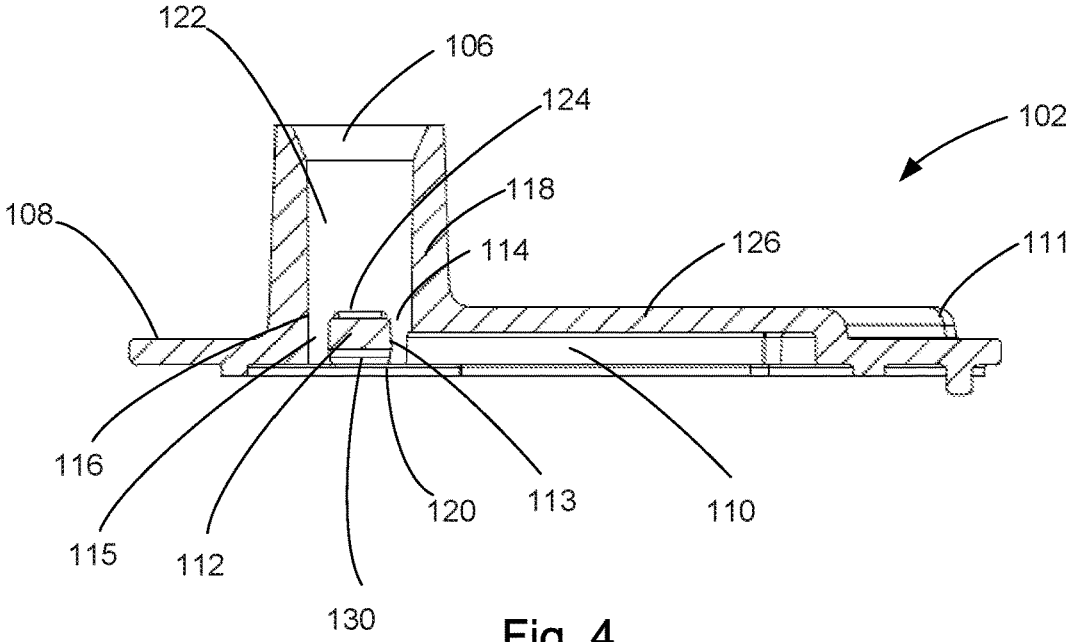
FIG. 4 is a cross-sectional view of the example manifold along the line A-A in FIG. 3.

Referring to FIG. 4, this shows a cross-sectional view through the manifold 102 along the line A-A in FIG. 3. The inlet 106 comprises a sleeve 118 which extends from the external surface 108 of the manifold 102. The element 112 is located at a base 120 of an interior 122 of the sleeve 118 and extends from the base 120 to engage an actuatable member of a flow control device or valve (not shown) in order to activate the flow control device or valve. The element 112 has an engagement surface 124 at its upper end to engage the actuatable member, which engagement surface 124 is flat.

The print fluid channel 110 comprises a raised structure 126 formed in the manifold 102 and provides fluid communication between the inlet 106 and an outlet end 111 of the print fluid channel 110, which outlet end 111 comprises an outlet (not shown) of the manifold 102. The interior 122 of the sleeve 118 and the print fluid channel 110 are closed at their respective bases 120 and 128 by an upper surface of the printhead (not shown in FIG. 4 but see reference 104 in FIG. 1) when connected to the manifold 102. Print fluid passes to the printhead through the outlet at the outlet end 111 of the print fluid channel 110.

The inlet 106 is in fluid communication with the outlet via the first 114 and second 116 print fluid passageways. Print fluid passes from an interior 122 of the sleeve 118 to the print fluid channel 110 via the first print fluid passageway 114. When the manifold 102 is connected to a printhead (not shown in FIG. 4 but see reference 104 in FIG. 1), the lower end of the second fluid passageway 116 is closed by the upper surface of the printhead. The second fluid passageway 116 therefore comprises a conduit 130 which passes between the first 113 and second 115 sides of the element 112, i.e. the conduit 130 connects the first 113 and second 115 sides of the element 112. The conduit 130 is located at the base 120 of the sleeve 118. The conduit 130 inhibits print fluid from collecting and remaining stationary at the second side 115 of the element 112, which may cause the print fluid to coagulate resulting in blockages. Both the first 114 and second 116 print fluid passageways are in fluid communication with the outlet of the manifold 102.

Figure 5:
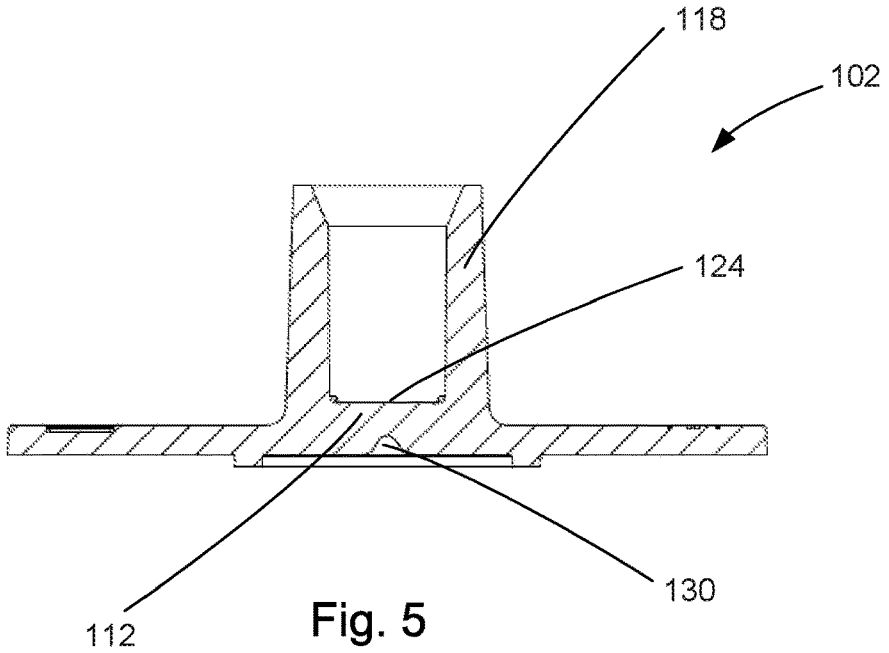
FIG. 5 is a cross-sectional view of the example manifold along the line B-B in FIG. 3.

Referring to FIG. 5, this shows a cross-sectional view through the manifold 102 along the line B-B in FIG. 3. As can be seen in FIG. 5, conduit 130 is located at the base of sleeve 118 and passes through element 112. Flat engagement surface 124 is located at an upper end of element 112 to engage the actuatable member of the flow control device (not shown).

Figure 6:
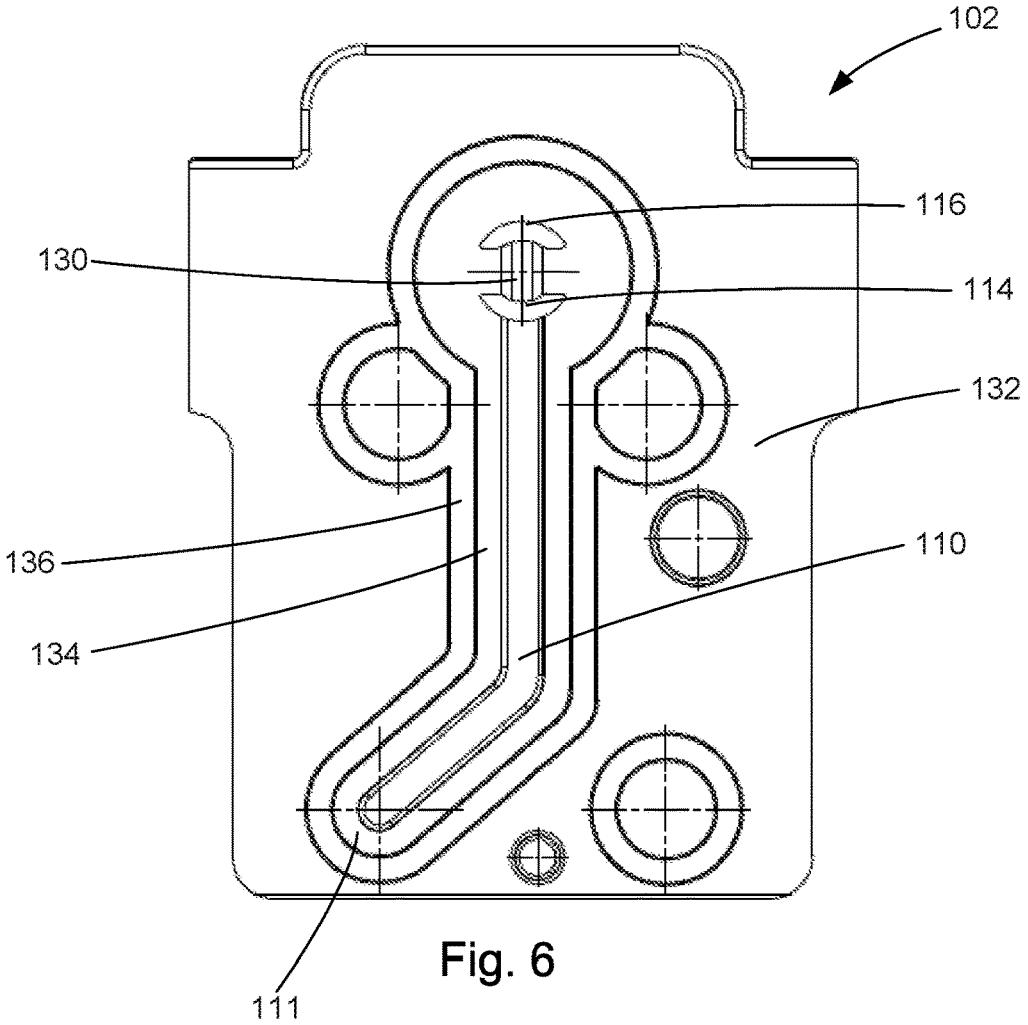
FIG. 6 is a bottom view of the example manifold.

FIG. 6 shows a bottom view of manifold 102 comprising a lower or interior surface 132 arranged to cooperate with an upper surface of a printhead (not shown). Print fluid passes through first print fluid passageway 114 and second print fluid passageway 116 and conduit 130 to print fluid channel 110. An outlet of the manifold 102 is located at an outlet end 111 of print fluid channel 110. The first 114 and second 116 print fluid passageways, conduit 130 and print fluid channel 110 are surrounded by perimeter seals 134 and 136 which seal to an upper surface of a printhead (not shown) to inhibit the egress of print fluid from the aforementioned features.

Figure 7:
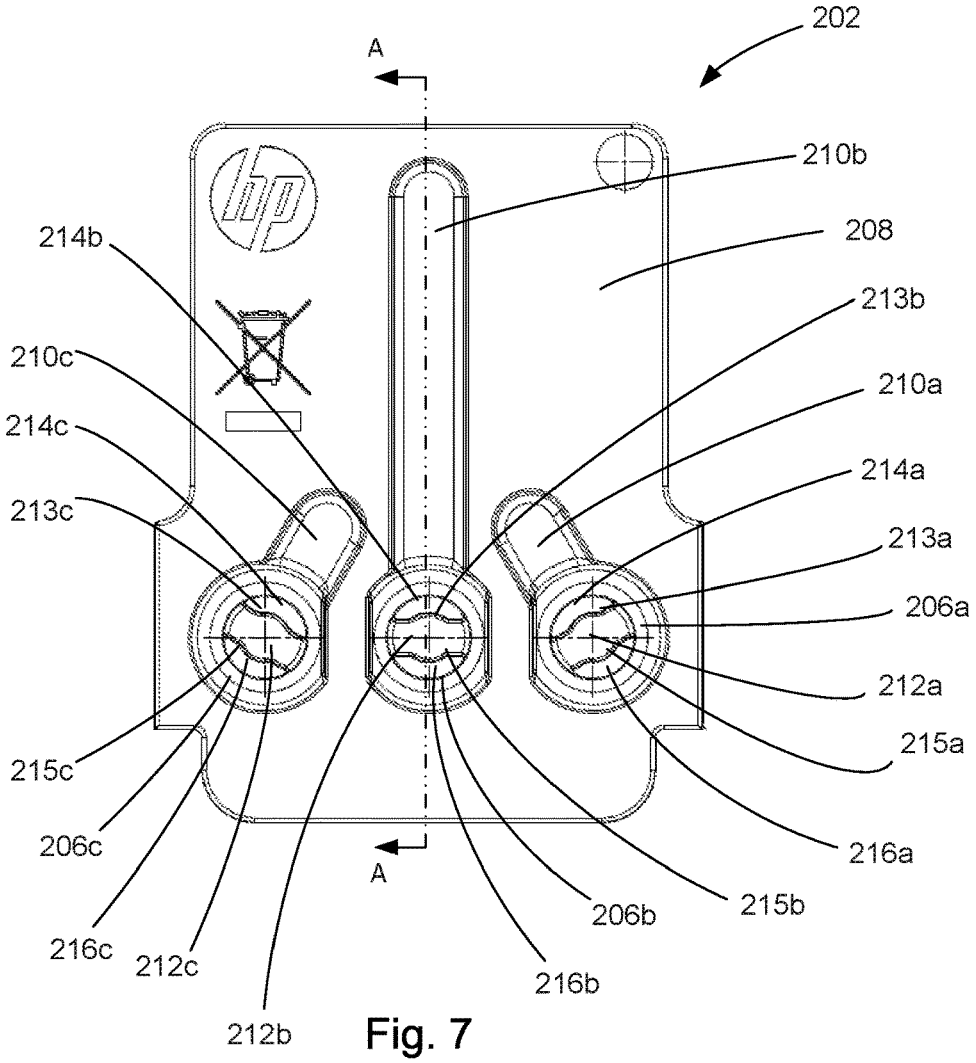
FIG. 7 is a plan view of another example of a manifold having three inlets.

Another example manifold 202 is shown in the plan view of FIG. 7. The manifold 202 comprises three inlets 206*a*, 206*b*, 206*c* which are formed at an upper or external surface 208 of the manifold 202. Each inlet 206*a*, 206*b*, 206*c* is connected to a respective outlet (not shown) by a respective print fluid channel 210*a*, 210*b*, 210*c*. An element or valve rib 212*a*, 212*b*, 212*c* extends across each of the inlets 206*a*, 206*b*, 206*c*. In the described example the elements 212*a*, 212*b*, 212*c* extend along a diameter of the inlets 206*a*, 206*b*, 206*c*. However, the skilled person will appreciate that the elements could extend in different configurations. The elements 212*a*, 212*b*, 212*c* divide the inlets 206*a*, 206*b*, 206*c* into respective first 214*a*, 214*b*, 214*c* and second 216*a*, 216*b*, 216*c* print fluid passageways which pass at respective first 213*a*, 213*b*, 213*c* and second 215*a*, 215*b*, 215*c* sides of the elements 212*a*, 212*b*, 212*c* respectively.

Figure 8:
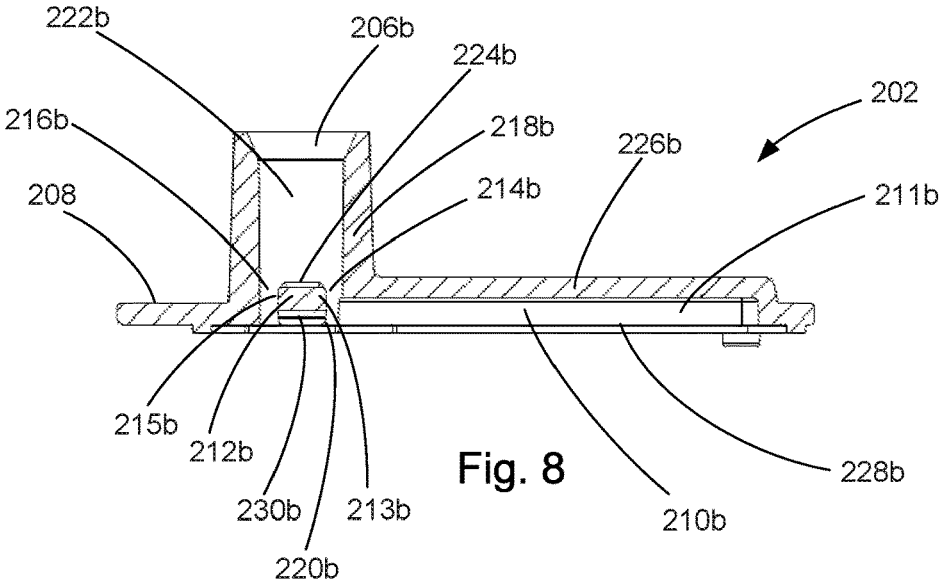
FIG. 8 is a cross-sectional view of the other example manifold along the line A-A in FIG. 7.

Referring to FIG. 8, this shows a cross-sectional view through the manifold 202 along the line A-A in FIG. 7. The inlet 206*b* comprises a sleeve 218*b* which extends from the external surface 208 of the manifold 202. The element 212*b* is located at a base 220*b* of an interior 222*b* of the sleeve 218*b* and extends from the base 220*b* to engage an actuatable member of a flow control device or valve (not shown) in order to activate the flow control device or valve. The element 212*b* has an engagement surface 224*b* at its upper end to engage the actuatable member, which engagement surface 224*b* is flat.

The print fluid channel 210*b* comprises a raised structure 226*b* formed in the manifold 202 and provides fluid communication between the inlet 206*b* and an outlet end 211*b* of the print fluid channel 210*b*, which outlet end 211*b* comprises an outlet (not shown) of the manifold 202. The interior 222*b* of the sleeve 218*b* and the print fluid channel 210*b* are closed at their respective bases 220*b* and 228*b* by an upper surface of the printhead (not shown in FIG. 8 but see reference 104 in FIG. 1) when connected to the manifold 202. Print fluid passes to the printhead through the outlet at the outlet end 211*b* of the print fluid channel 210*b*.

The inlet 206*b* is in fluid communication with the outlet via the first 214*b* and second 216*b* print fluid passageways. Print fluid passes from an interior 222*b* of the sleeve 218*b* to the print fluid channel 210*b* via the first print fluid passageway 214*b*. When the manifold 202 is connected to a printhead (not shown in FIG. 4 but see reference 104 in FIG. 1), the lower end of the second fluid passageway 216*b* is closed by the upper surface of the printhead. The second fluid passageway 216*b* therefore comprises a conduit 230*b* which passes between the first 213*b* and second 215*b* sides of the element 212*b*, i.e. the conduit 230*b* connects the first 213*b* and second 215*b* sides of the element 212*b*. The conduit 230*b* is located at the base 220*b* of the sleeve 218*b*. The conduit 230*b* inhibits print fluid from collecting and remaining stationary at the second side 215*b* of the element 212*b*, which may cause the print fluid to coagulate resulting in blockages. Both the first 214*b* and second 216*b* print fluid passageways are in fluid communication with the outlet of the manifold 102.

Each of the other inlets 206*a*, 206*c* and respective print fluid channels 210*a*, 210*c* shown in FIG. 7 have corresponding features to those discussed in respect of FIG. 8 above.

Figure 9:
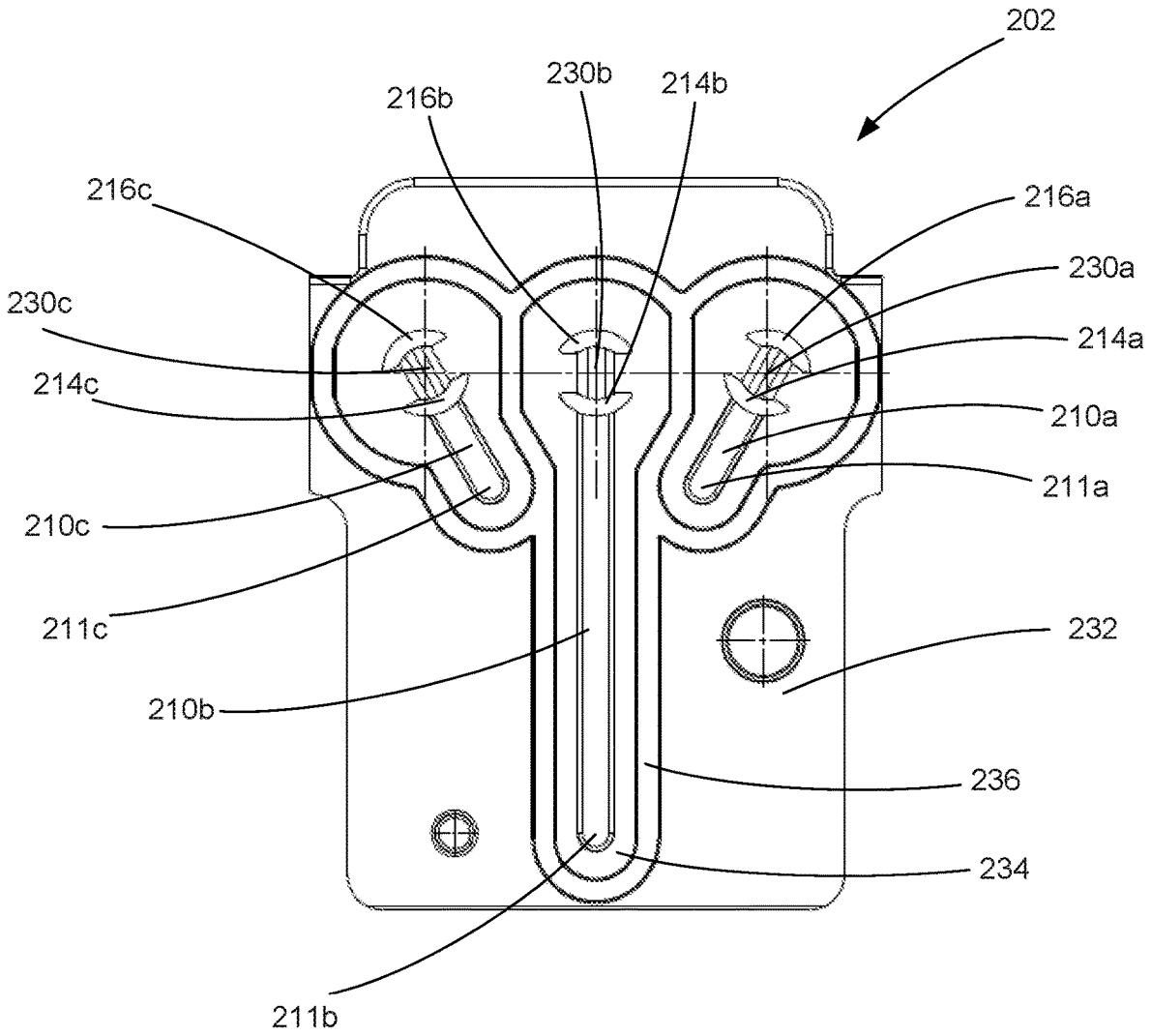
FIG. 9 is a bottom view of the other example manifold.

FIG. 9 shows a bottom view of manifold 202 comprising a lower or interior surface 232 arranged to cooperate with an upper surface of a printhead (not shown). Print fluid passes through each of the first print fluid passageways 214*a*, 214*b*, 214*c* and second print fluid passageways 216*a*, 216*b*, 216*c* and conduits 230*a*, 230*b*, 230*c* to respective print fluid channels 210*a*, 210*b*, 210*c*. Three outlets of the manifold 202 are located at respective outlet ends 211*a*, 211*b*, 211*c* of print fluid channels 210*a*, 210*b*, 210*c* respectively. The first 214*a*, 214*b*, 214*c* and second 216*a*, 216*b*, 216*c* print fluid passageways, conduits 230*a*, 230*b*, 230*c* and print fluid channels 210*a*, 210*b*, 210*c* are surrounded by perimeter seals 234 and 236 which seal to an upper surface of a printhead (not shown) to inhibit the egress of print fluid from the aforementioned features.

Figure 10:
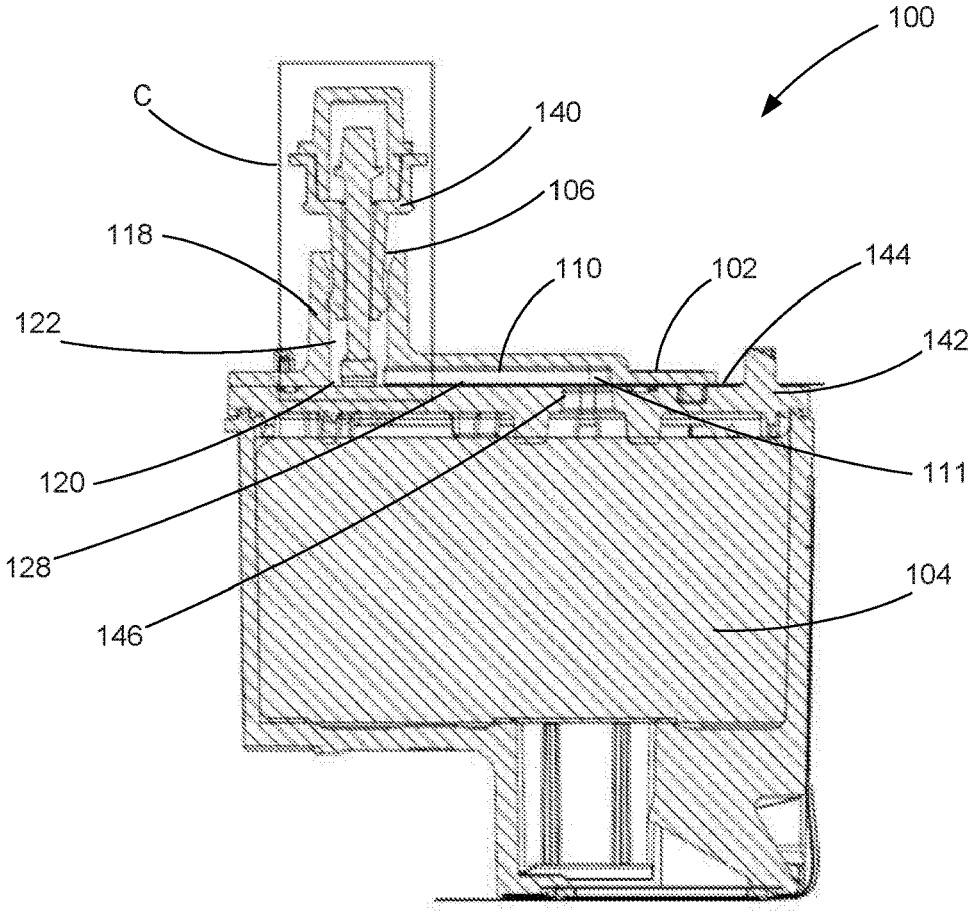
FIG. 10 is a cross-sectional view of the example printhead assembly with a needle valve engaged with the inlet.

Referring to FIG. 10, this shows a cross-sectional view of the example printhead assembly 100 with a needle valve 140 engaged with the inlet 106. The printhead assembly 100 comprises the example manifold 102 and a printhead 104. The manifold 102 is laser welded to an upper surface 144 of the printhead 104, although the skilled person will appreciate that other methods of attachment could be used. The upper surface 144 provides a base 120 for the sleeve 118 and that the print fluid channel 110. Print fluid is supplied to the inlet 106 when the needle valve 140 is activated and flows from an interior 122 of the sleeve 118 to an outlet end 111 of the print fluid channel 110. The outlet end 111 of the print fluid channel 110 corresponds with an opening 146 in the upper surface 144 of the printhead 104, through which opening 146 print fluid is delivered to the printhead 104.

Figure 11:
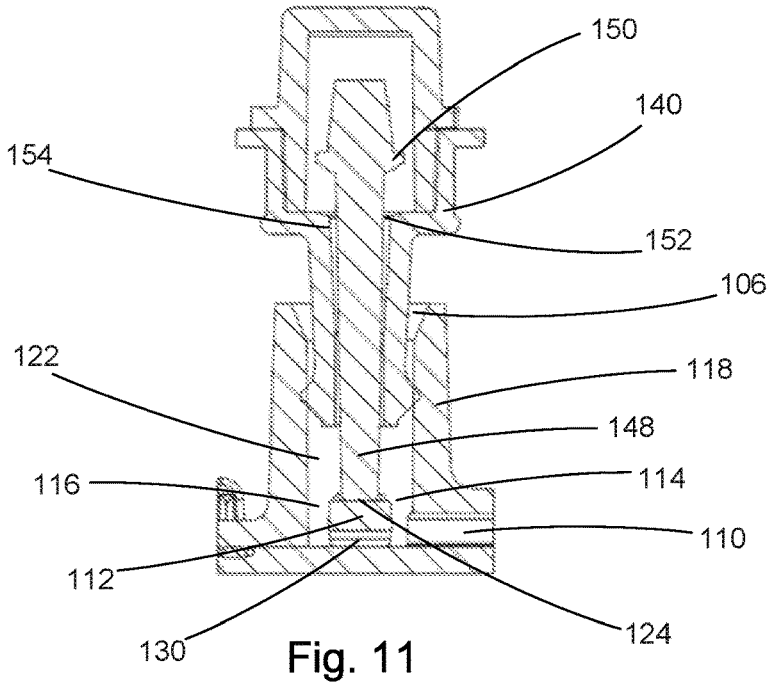
FIG. 11 is an enlarged view of box C in FIG. 10 showing the needle valve engaged with the inlet.

FIG. 11 shows in more detail the coupling of the needle valve 140 with the inlet 106 of the manifold 102. The needle valve 140 is inserted into sleeve 118 such that needle 148 engages engagement surface 124 of element 112. The sleeve 118 acts as a female connector for mating or coupling with the needle valve 140. The needle valve 140 is normally closed by a resilient biasing element (not shown) which urges the needle 148 to a position in which valve flange 150 contacts valve seat 152 thereby closing valve outlet 154. The height of the element 112 is such that, when the needle valve 140 is received within sleeve 118, the needle 148 engages the element 116 and is pushed back against the action of the resilient biasing element, thereby moving valve flange 150 away from valve seat 152 and opening valve outlet 154. This activates the needle valve 140 and allows print fluid to flow into the sleeve 118. Therefore, in the described disclosure, the needle 148 acts as an actuatable member of the needle valve 140.

The needle valve 140 is connected to a print fluid supply or reservoir (not shown) and acts as a flow control device which controls the flow of print fluid from the print fluid supply to the manifold 102. In one example, the needle valve may be mounted on a printer carriage of a continuous ink supply system (CISS) and is opened when the printer head assembly 100 is mounted on the printer carriage.

Print fluid flows from an interior 122 of the sleeve 118 to the print fluid channel 110 via first print fluid passageway 114 or via second print fluid passageway 116 and conduit 130. The surface area of the engagement surface 124 of element 112 presented to the needle 148 is sufficient to enable the needle valve 140 to be actuated even if there is misalignment between the needle 148 and the centre of the element 112. In addition, the width of the first 114 and second 116 print fluid passageways on either side of the element 112 is smaller than the width of the needle 148 to reduce the chance of the needle 148 becoming wedged between the interior sidewall of the sleeve 118 and the element 112 in the event of misalignment.

All references made herein to orientation (e.g. upper, lower, top, bottom) are made for the purposes of describing relative spatial arrangements of the features of the disclosed examples, and are not intended to be limiting in any sense. The skilled person will appreciate that references made to orientation or direction herein are with respect to the orientation shown in the figures or the disclosed examples in normal use.

As used herein any reference to "one example" or "an example" or like terms or phrases means that a particular element, feature, structure, or characteristic described in connection with the example is included in at least one example. The appearances of the phrase or "in one example" or "in an example" or the like terms or phrases in various places in the specification are not necessarily all referring to the same example.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the disclosure or an example. This is done merely for convenience and to give a general sense of the disclosure. This description should be read to include one or at least one and the singular also includes the plural unless it is obvious that it is meant otherwise.

In view of the foregoing description it will be evident to a person skilled in the art that various modifications may be made within the scope of the disclosure. For example, a material other than a plastics material may be used to form the deformable walls of the fluid interconnect bridge. Such a material should be impervious to the printing fluid or fluids to be used and to have a structure such that a wall of a hollow tube conduit made from the material may be deformed to occlude the tube by a force that mat be provided by a print head when it is inserted in a print head carriage. Additionally, although the disclosure has been described with reference to heavy inks the disclosure may be applied to using other inks or fluids. The teaching and general concept disclosed herein is not limited to printers or printing technology.

The scope of the present disclosure includes any novel feature or combination of features disclosed therein either explicitly or implicitly or any generalisation thereof irrespective of whether or not it relates to the claimed subject matter or mitigate against any or all of the issues addressed by the present disclosure. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. A manifold to provide print fluid to a printhead, the manifold comprising:

an inlet to receive print fluid from a print fluid supply; and an outlet to provide print fluid to the printhead;

the inlet to couple with a flow control device to control flow of print fluid from the print fluid supply to the manifold; and wherein the inlet comprises a sleeve to receive the flow control device, and an element fixed within the sleeve to engage an actuatable member of the flow control device to activate the flow control device to allow print fluid to flow from the print fluid supply to the printhead.

2. The manifold of claim 1, wherein the element is arranged to provide an engagement surface and a print fluid passageway within the inlet, the engagement surface to engage the actuatable member of the flow control device.

3. The manifold of claim 2, wherein the element extends across the inlet.

4. The manifold of claim 3, wherein the print fluid passageway passes at a side of the element.

5. The manifold of claim 4, wherein the print fluid passageway comprises a first print fluid passageway and the side comprises a first side of the element, the manifold further comprising a second print fluid passageway which passes at a second side of the element, wherein the second print fluid passageway comprises a conduit which passes between the first and second sides of the element.

6. The manifold of claim 5, wherein the first and second print fluid passageways are in fluid communication with the outlet.

7. The manifold of claim 2, wherein the width of the first and second print fluid passageways is less than the width of the actuatable member.

8. The manifold of claim 2, wherein the engagement surface is flat.

9. The manifold of claim 1, wherein the sleeve extends from an external surface of the manifold.

10. The manifold of claim 9, wherein the element is located at a base of an interior of the sleeve and extends from the base of the sleeve to engage the actuatable member to activate the flow control device.

11. The manifold of claim 9, wherein the conduit is located at the base of the sleeve.

12. The manifold of claim 1, further comprising a print fluid channel to provide fluid communication between the inlet and the outlet.

13. The manifold of claim 1, wherein the element comprises a valve rib.

14. The manifold of claim 1, wherein the manifold comprises a plurality of inlets, outlets and print fluid channels.

15. A manifold to provide print fluid to a printhead, the manifold comprising:

an inlet to receive print fluid from a print fluid supply; and an outlet to provide print fluid to the printhead;

the inlet to couple with a flow control device to control flow of print fluid from the print fluid supply to the manifold; and wherein the inlet comprises a sleeve to receive the flow control device, and an element to engage an actuatable member of the flow control device to activate the flow control device to allow print fluid to flow from the print fluid supply to the printhead, wherein the element is to split a flow of the print fluid within the sleeve.

16. The manifold of claim 15, comprising a conduit positioned within the sleeve that passes through the element.

17. The manifold of claim 16, wherein the element is located at a base of an interior of the sleeve and extends from the base of the sleeve to engage the actuatable member to activate the flow control device.

18. A manifold to provide print fluid to a printhead, the manifold comprising:

an inlet to receive print fluid from a print fluid supply; and an outlet to provide print fluid to the printhead;

the inlet to couple with a flow control device to control flow of print fluid from the print fluid supply to the manifold; and wherein the inlet comprises a sleeve to receive the flow control device, and an element fixed within the sleeve to engage an actuatable member of the flow control device to activate the flow control device to allow print fluid to flow from the print fluid supply to the printhead, wherein the element is to split a flow of the print fluid within the sleeve.

19. The manifold of claim 18, comprising a conduit positioned within the sleeve that passes through the element.

20. The manifold of claim 19, wherein the element is located at a base of an interior of the sleeve and extends from the base of the sleeve to engage the actuatable member to activate the flow control device.

* * * * *